US005271600A

United States Patent [19]

Saadi et al.

[11] Patent Number: 5,271,600

[45] Date of Patent: Dec. 21, 1993

[54] DIAPHRAGM ASSEMBLY

[75] Inventors: Robert E. Saadi, Erie; Christopher C. Knoll, Fairview; John Beaumont, Harborcreek; John D. Ralston; Robert E. Farrell, both of Erie, all of Pa.

[73] Assignee: Zurn Industries, Inc., Erie, Pa.

[21] Appl. No.: 62,829

[22] Filed: May 14, 1993

Related U.S. Application Data

[62] Division of Ser. No. 948,095, Sep. 21, 1992, Pat. No. 5,232,194.

[51] Int. Cl.[5] ..... F16K 31/385

[52] U.S. Cl. ..... 251/40; 251/120

[58] Field of Search ..... 251/84, 40, 120

[56] References Cited

U.S. PATENT DOCUMENTS

| | | | |
|---|---|---|---|
| 1,845,052 | 2/1932 | Laukel | 205/67 |
| 1,942,837 | 1/1934 | Schultheiss | 251/40 |
| 1,965,328 | 7/1934 | Wright | 251/40 |
| 2,007,652 | 7/1935 | Kocour | 251/40 |
| 2,024,270 | 12/1935 | Binnall | 251/40 |
| 2,075,029 | 3/1937 | Duncan, Jr. | 251/40 |
| 2,136,221 | 11/1938 | Sloan | 251/40 |
| 2,164,760 | 7/1939 | Wesson | 251/40 |
| 2,210,860 | 8/1940 | Regnell | 251/40 |
| 2,406,259 | 8/1946 | Russell et al. | 251/40 |
| 2,472,576 | 6/1949 | Dobrick | 251/40 |
| 2,620,826 | 12/1952 | Johns | 251/40 |
| 3,279,742 | 10/1966 | Billeter | 251/40 |
| 4,134,570 | 1/1979 | Walker | 251/40 |
| 4,327,891 | 5/1982 | Allen et al. | 251/38 |
| 4,817,913 | 4/1989 | Whiteside | 251/40 |
| 4,858,638 | 8/1989 | Cseri | 137/115 |
| 4,883,254 | 11/1989 | Whiteside | 251/335.2 |
| 4,913,182 | 4/1990 | Whiteside | 137/614.2 |
| 5,013,007 | 5/1991 | Whiteside | 251/40 |

*Primary Examiner*—George L. Walton

*Attorney, Agent, or Firm*—Webb, Burden, Ziesenheim & Webb

[57] ABSTRACT

A unitary diaphragm assembly for use in conventional flush valves. The diaphragm assembly has a flexible diaphragm which includes a seating portion and a mounting portion at the outer peripheral edge. A flow ring is positioned adjacent to the seating portion of the diaphragm. An elongated barrel member extends from the diaphragm in a longitudinal direction and includes a plurality of radial guides positioned circumferentially around the outer surface of the barrel member along a portion of the length of the barrel member. A second embodiment has a flexible diaphragm connected to a cylinder slide. The cylinder slide includes a longitudinal barrel member with a relief valve positioned in the interior of the lower portion of the barrel member.

3 Claims, 3 Drawing Sheets

DIAPHRAGM ASSEMBLY

This is a divisional of copending application Ser. No. 07/948,095 filed on Sep. 21, 1992 now U.S. Pat. No. 5,232,194.

BACKGROUND OF THE INVENTION

I. Field of the Invention

This invention relates in general to improvements in flush valves for water closets, urinals, and other plumbing equipment. More particularly, the invention relates to an improved diaphragm for use in flush valves.

II. Description of the Related Art

Flush valves in water closets, urinals, and other plumbing devices which utilize a flexible diaphragm to establish and to seal off the connection between the inlet and outlet are well-known in the art. FIG. 1 illustrates a typical prior art flush valve and diaphragm assembly. The flush valve has a hollow body 10, generally made of brass, which includes an inlet connection 12, an outlet connection 14, and a handle connection 16. Barrel 18 is positioned within the flush valve such that the connection between inlet 12 and outlet 14 is through barrel 18. An annular main valve seat 20 is formed on the top of the barrel 18 Annular main valve seat 20 is normally closed by diaphragm 22 extending across body 10 and defining an upper chamber 24. Diaphragm 22 has a bypass 26 which provides fluid communication between the inlet side of the flush valve and upper chamber 24. Diaphragm 22 is attached at its outer edge to the valve body and is clamped in place by an annular clamping rim on the outer cover 11 of body 10. The center of diaphragm 22 has an opening which allows for fluid communication between upper chamber 24 and outlet 14. A relief valve 28 normally closes the opening at the center of the diaphragm.

The operation of the flush valve is generally as follows. In the normally closed position shown in FIG. 1, water pressure at the valve inlet is communicated to upper chamber 24 through bypass 26. Since the surface area which is subjected to water pressure is greater on the upper side of diaphragm 22, the water pressure forces diaphragm 22 down onto valve seat 20 preventing water from flowing to outlet 14. When the user moves the handle 30 in any direction, the plunger 32 moves inwardly tilting the stem 34 of relief valve 28. This releases the pressure in upper chamber 24 by allowing water to flow through a guide member 36. With the upper chamber pressure relieved, the inlet water pressure forces diaphragm 22 upwardly, off main valve seat 20 allowing water to flow directly from inlet 12 through barrel 18 to outlet 14. When diaphragm 22 and relief valve 28 move upwardly, relief valve 28 resets itself, closing off upper chamber 24. Water will then flow through bypass 26 into upper chamber 24 until diaphragm 22 is again forced against main valve seat 20, thereby closing the valve. Guide member 36 moves with diaphragm 22 and includes outwardly extending radial wing members 38 which engage the inner surface of barrel 18 to guide the guide member 36 and attached diaphragm 22 as diaphragm 22 moves up and down.

The diaphragm assembly of the prior art device comprises diaphragm 22, relief valve 28, stem 34, guide member 36, wing members 38, retaining disc 40, as well as the flow ring 42. This prior art diaphragm assembly suffers from several distinct disadvantages.

Diaphragm 22 uses diaphragm tabs and rings to lend rigidity to the otherwise extremely flexible rubber parts. The rigidity of diaphragm 22 is critical to performance. Retaining disc 40 utilizes brass threads to attach the diaphragm 22 to guide member 36. Within diaphragm 22 rubber is bonded to the brass parts to obtain acceptable seating surfaces. This combined use of rubber and brass for the diaphragm 22 and the retaining disc 40 increases manufacturing costs and assembly time.

The multi-piece prior art diaphragm assembly results in tolerance stack-up variations leading to flow variations between different valves. This prior art device allows for separation of the diaphragm tab from the diaphragm rubber, resulting in the shortening of the diaphragm life. Furthermore, the separation of the diaphragm tab creates rubber particles which may clog bypass 26.

U.S. Pat. Nos. 4,817,913, 4,883,254, 4,913,182 and 4,968,067, all to Whiteside, disclose a substantially unitary diaphragm assembly. However, the diaphragm assemblies of these devices are utilized with a different valve assembly such that the diaphragm assembly does not include a flow ring, retaining disc or wing members. Furthermore, the diaphragm assembly of Whiteside requires the utilization of a redesigned relief valve.

The object of the present invention is to overcome the above-identified drawbacks of the prior art by utilizing an improved diaphragm assembly to control the flow parameters of a flush valve which flushes, rinses and refills water closets and urinals in a consistent, quiet, quick and effective manner. The object of the present invention is to provide a diaphragm assembly which may be utilized with a common valve assembly.

SUMMARY OF THE INVENTION

The objects of the present invention are obtained by providing a diaphragm assembly which is designed to be molded as a unitary diaphragm molded from thermoplastic and thermoplastic elastomer resins. The use of thermoplastic elastomer material in the invention combines rubber's compressibility/sealing characteristics with plastic's moldable/rigid structure characteristics. This combination allows for the unitary diaphragm design of the present invention which will meet and exceed the performance required. A second embodiment of the invention incorporates a four-piece diaphragm assembly design. This design includes an injection molded plastic cylinder slide, two rubber or thermoplastic elastomer seats which are bonded to the cylinder slide to effect a seal at the main valve seat and the relief valve seat, and a diaphragm made of thermoplastic elastomer material which provides the assembly's flexing properties and outer periphery sealing properties.

The one-piece, integral diaphragm assembly for use in a flush valve includes a flexible diaphragm having a seating portion and a mounting means for mounting the diaphragm assembly within a flush valve positioned at a peripheral edge of the diaphragm. A flow ring or flow control skirt is positioned adjacent the diaphragm seating portion. An elongated barrel member is positioned adjacent the flow ring. A plurality of radial barrel guides are spaced around the outer surface of the barrel and extend substantially coaxially along at least a portion of the barrel member. A relief valve seat is positioned adjacent the diaphragm to allow for seating of the relief valve of the flush valve assembly.

The diaphragm assembly of the present invention is specifically designed to be interchangeable with present diaphragm assemblies used in flushometer valves. The present design improves the consistency, reliability and expected life of the diaphragm unit by reducing the number of parts and eliminating parts which cause undesirable wear and corrosion.

The design of the present invention allows for reduced unit costs due to a decrease in part manufacturing costs and the elimination of diaphragm assembly costs. The design allows for improved control of tolerances due to a unitary design resulting in improved performance from valve to valve as well as reduced part scrappage. Furthermore, lower inventory costs result due to the reduction in the total number of parts in the diaphragm design. The elimination of the diaphragm tab results in increased consistent operating life.

Other objects and advantages of the present design will become apparent in the description of the preferred embodiments described in association with the attached drawings wherein like reference characters describe like parts.

BRIEF DESCRIPTION OF THE PREFERRED EMBODIMENTS

Figure 1:
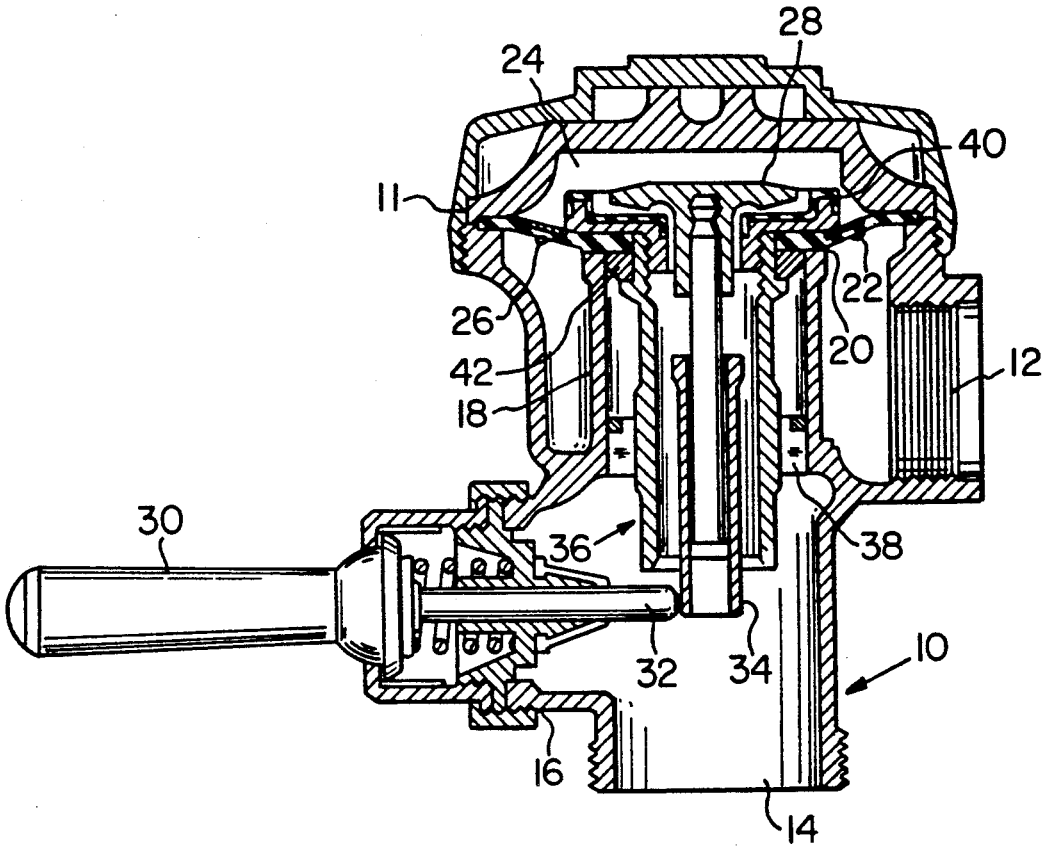
FIG. 1 PRIOR ART
FIG. 1 is a prior art illustration of a flush valve and conventional diaphragm assembly.
Figure 2:
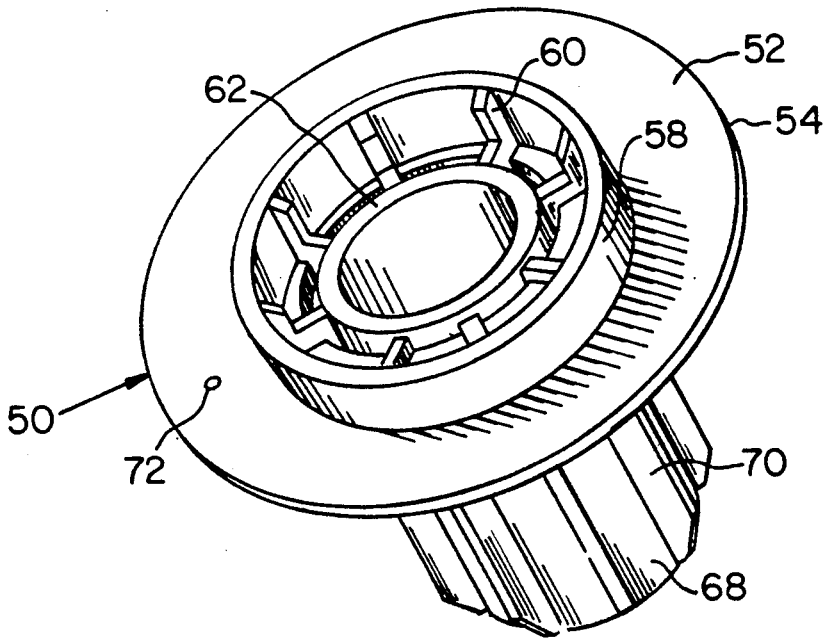
FIG. 2 is a perspective view of a unitary diaphragm assembly of the present invention.

FIG. 2 illustrates a unitary diaphragm assembly 50 which is designed to be utilized in flush valves of the type illustrated in FIG. 1, replacing the complicated diaphragm assemblies of these devices Unitary diaphragm assembly 50 is molded as a single piece from thermoplastic elastomer resin. Unitary diaphragm assembly 50 includes a diaphragm 52 which has a mounting portion 54 at the outer peripheral edge Mounting portion 54 may be assembled into a "C" channel type gasket similar to that shown in FIG. 1 to effect a seal.

Figure 3:
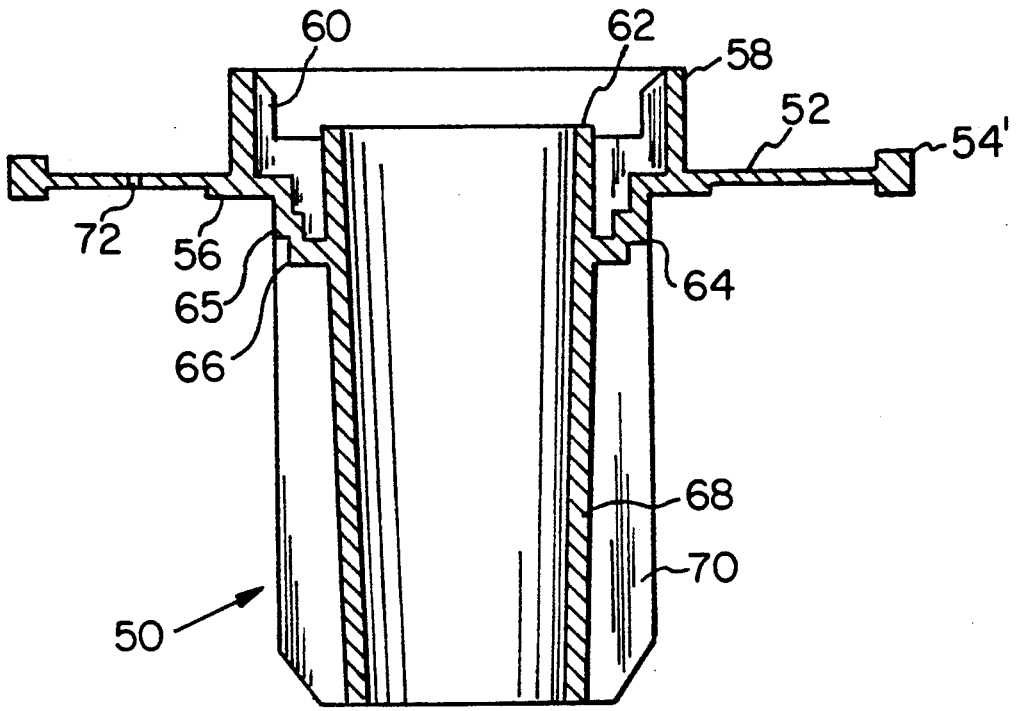
FIG. 3 is a vertical section of a modified diaphragm assembly illustrated in FIG. 2.

With reference to FIG. 3, a sealing surface 56 is positioned at a generally radially inward position relative to diaphragm 52 so as to cooperate with the main valve seat 20 of a flush valve. An annular support 58 extends upwardly from diaphragm 52 above the portion of the diaphragm having sealing surface 56. Radial reinforcing ribs 60 extend between the upper end of barrel member 68 adjacent relief valve seat 62 and annular support 58 to reinforce annular support 58, relief valve seat 62 and sealing surface 56. The vertical legs of ribs 60 maintain relief valve 28 of the flush valve in position so that it may seal against relief valve seat 62. Reinforcing ribs 60 also extend to a flow ring 64 located on barrel 68 below sealing surface 56 to add structural support for flow ring 64.

Relief valve seat 62 is positioned on the upper end of barrel member 68. Barrel member 68 is designed to cooperate with barrel 18 of a flush valve and extends substantially coaxially along the length of barrel 18. The outer surface of barrel member 68 is provided with radial guides 70. Guides 70 engage the inner surface of barrel 18 to maintain diaphragm assembly 50 in the proper alignment as it moves up and down in barrel 18. The flow ring 64 controls the flow of water when diaphragm assembly 50 is in the open position Guides 70 provide structural support to the flow ring 64. Guides 70 may extend substantially along the entire length of the barrel member 68, as shown, for ease of manufacture Alternatively, the guides 70 may extend only along a portion of the barrel member 68. Additionally, the guides 70 may serve to support a supplemental flow control ring (not shown) which is positioned within the barrel 18.

FIG. 3 also illustrates a modified mounting portion 54' of diaphragm 52. The modified mounting portion 54' has a greater thickness than the mounting portion 54 shown in FIG. 2. This design eliminates the need of the "C" channel type gasket.

The flow ring 64 includes a first stage 65 having a diameter larger than a second stage 66 which creates a stepped configuration of the flow ring. The size and shape of the flow ring may be modified for different flush valve flow requirements.

The unitary diaphragm assembly 50 may also be provided with a bypass orifice 72 which is positioned within diaphragm 52. The unitary diaphragm assembly 50 is designed to operate in an analogous manner to the diaphragm assembly of the prior art.

Figure 4A:
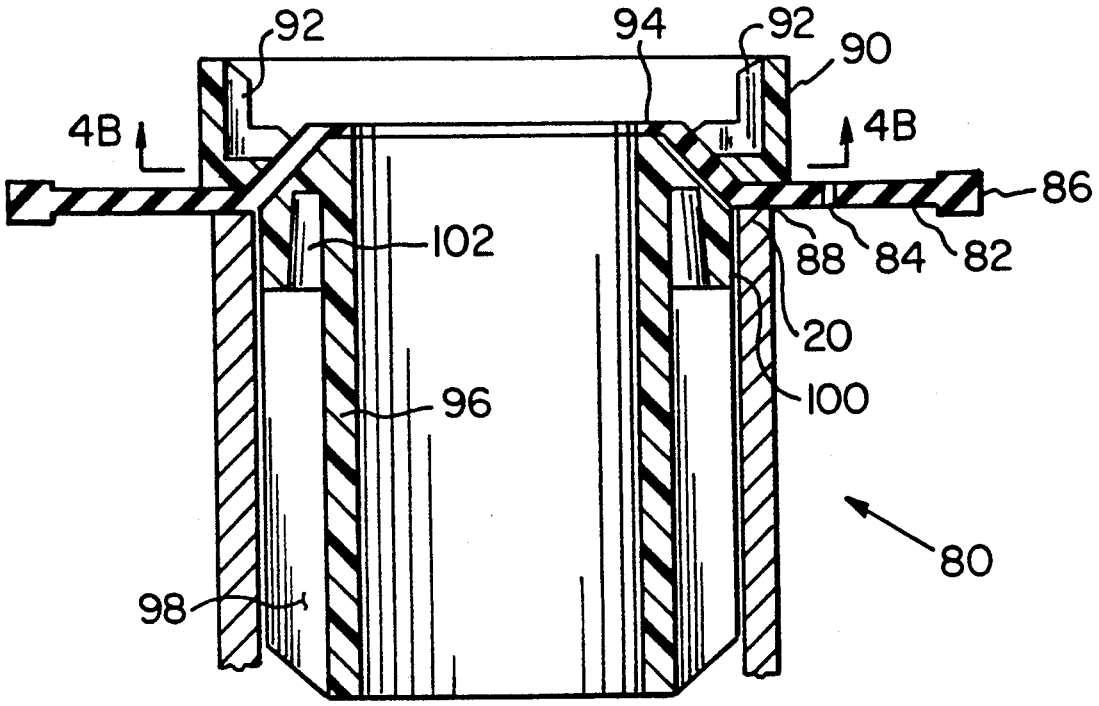
FIG. 4A is a vertical section of a modified diaphragm assembly.

FIG. 4A illustrates a unitary diaphragm assembly 80 which is also designed to be utilized in flush valves of the type illustrated in FIG. 1. Unitary diaphragm assembly 80 is illustrated in position within the valve barrel 18. The unitary diaphragm assembly 80 is comolded as a single piece from a thermoplastic elastomer material and a polypropylene or polyethylene material.

Unitary diaphragm assembly 80 includes a diaphragm 82 with a flow control bypass orifice 84 extending therethrough. A large mounting portion 86 is provided at the outer peripheral edge of the diaphragm 82. A sealing surface 88 is positioned at a radially inward position relative to the diaphragm 82 so as to cooperate with the main valve seat 20 of the flush valve. The unitary diaphragm assembly 80 is similar to the unitary diaphragm assembly 50 and includes an annular support 90 extending upwardly from the diaphragm 82, radially reinforcing ribs 92 positioned adjacent the annular support to reinforce the annular support, and a relief valve seat 94 at an upper end of a barrel member 96. The unitary diaphragm assembly 80 also includes radial guides 98 extending along the barrel 96.

Figure 4B:
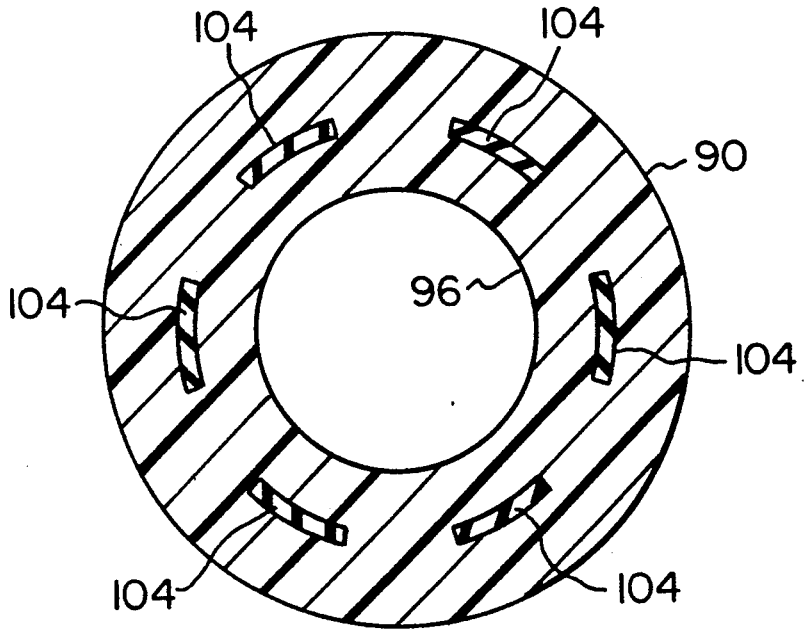
FIG. 4B is a cross section of the diaphragm assembly illustrated in FIG. 4A.

The unitary diaphragm 80 is distinguishable from the unitary diaphragm 50 by the provision of a flow control skirt 100 which is provided with a plurality of reinforcing ribs 102, and the multiple materials which form the unitary diaphragm 80. The flow control skirt 100 may be changed in size by notching appropriate sections of the flow control skirt to obtain the proper flow. The unitary diaphragm assembly 80 includes multiple material pathways 104, as best seen in FIG. 4B, to provide for the molding of the unitary diaphragm 80. The unitary diaphragm 80 may be formed by co-injection molding, insert molding, transfer molding or other applicable method sufficient to form the unitary structure. With this construction, the diaphragm 82, mounting portion 86, sealing surface 88 and relief valve seat 94 may be molded from a thermoplastic elastomer material which will provide sufficient sealing surfaces and flange flexibility necessary for proper functioning of the diaphragm assembly 80. The remaining portions of the unitary diaphragm assembly can be molded to facilitate the structural strength and rigidity necessary to support plumbing water supply pressure loads. The barrel and associated parts can be formed from an ABS, polypropylene or polyethylene material to supply the necessary structural rigidity to the diaphragm assembly frame. This design also maintains the advantages of a unitary diaphragm assembly.

Various modifications and additions may be made to the unitary diaphragm assemblies shown in FIGS. 2–4B without changing the essential features of the invention For example, supplemental sealing rings or gaskets may be added to the valve seats (56, 62, 88 and 94) to enhance sealing characteristics of the device or supplemental flow control devices may be added as needed.

Figure 5:
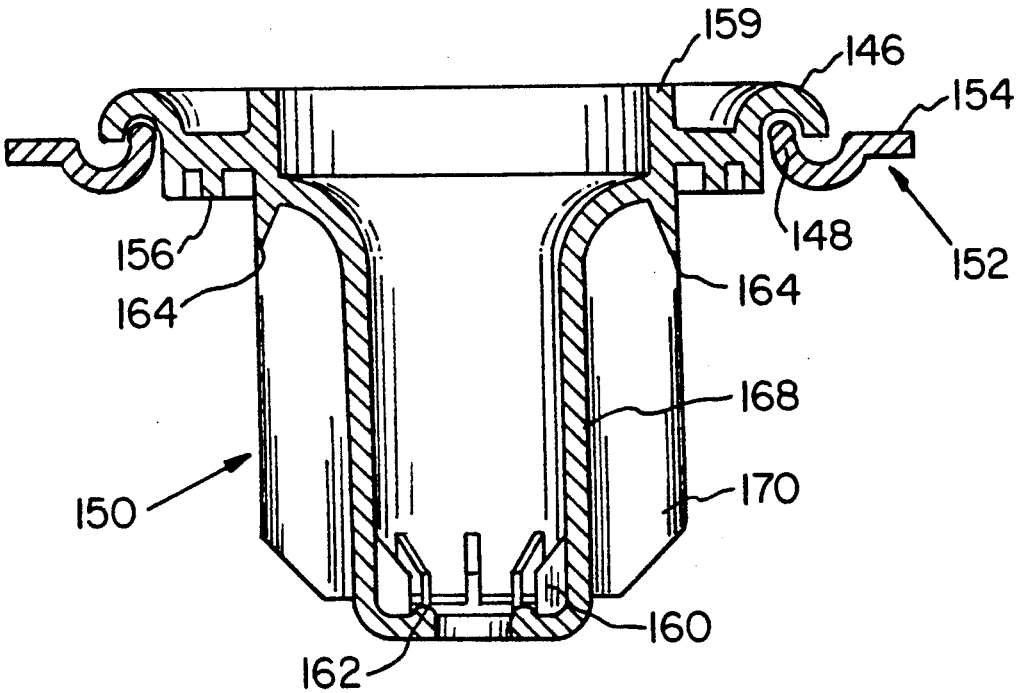
FIG. 5 is a diaphragm assembly of a second embodiment of the invention.

FIG. 5 shows a diaphragm assembly of a second embodiment of the present invention. The diaphragm assembly of this embodiment includes a diaphragm 152 having a mounting portion 154 at the outer peripheral edge. An arcuate connecting portion 148 is provided on the inner peripheral portion of diaphragm 152. The diaphragm connecting portion 148 is adapted to cooperate with a connecting portion 146 of a cylinder slide 150. The connecting portions 146 and 148 allow for the required connection between diaphragm 152 and cylinder slide 150 as well as allowing for the required movement of the diaphragm assembly.

The cylinder slide 150 includes a diaphragm connecting portion 146, sealing surface 156, annular support 159, positioning rims 160, relief valve seat 162, flow ring 164, barrel member 168 and radial guides 170.

In the diaphragm assembly of the second embodiment relief valve 28 is adapted to be positioned at the bottom of barrel member 168 of cylinder slide 150. Positioning ribs 160 serve to position the relief valve 28 on the relief valve seat 162.

The cylinder slide 150 may preferably be formed by injection molding. Furthermore, two rubber or thermoplastic elastomer seats (not shown) may be bonded to the cylinder slide to effect a better seal at the valve seat and the relief valve seat. These rubber or thermoplastic seals would be attached to the cylinder slide sealing surface 156 and the relief valve seat 162.

The modified design allows positioning relief valve 28 closer to the actuating handle 30 and plunger 32 of flush valve 10 and requires a smaller relief valve 28 due to the smaller diameter of relief valve seat 162. The modified design also permits manufacturing the diaphragm assembly by injection molding A conventional bypass orifice (not shown) may be incorporated into diaphragm 152 or adjacent seal 156 such that the diaphragm assembly operates in the same manner as the diaphragm assemblies described above.

Although the preferred forms of the invention have been shown and described herein, it should be realized that there may be many modifications, substitutions and alterations thereto without departing from the spirit and scope of the present invention. The scope of the present invention is set forth in the following claims.

What is claimed is:

1. A diaphragm assembly for use in a flush valve comprising:

an annular flexible diaphragm having a connecting portion at the inner peripheral edge and a mounting portion at the outer peripheral edge for mounting the diaphragm assembly within a flush valve; and a cylinder slide having a connecting portion adapted to cooperate with said connecting portion of said diaphragm, a cylinder slide sealing surface adapted to cooperate with a main valve sealing surface, an elongated barrel member adjacent to said sealing portion and extending longitudinally from said diaphragm, a plurality of radial guides positioned circumferentially around said barrel member and extending along a portion of the length of said barrel member, a relief valve seat positioned in the interior of said barrel member at the bottom thereof and below said main valve sealing surface adapted to sealingly engage a relief valve of a flush valve assembly and a plurality of circumferentially spaced radial ribs positioned around said relief valve seat within said barrel member for accommodatingly positioning and guiding said relief valve to and from said valve seat.

2. The diaphragm assembly of claim 1 including a flow control means adjacent said seating surface.

3. The diaphragm assembly of claim 2 wherein said radial guides are attached to said flow control means.

* * * * *